US006675520B2

(12) United States Patent
Burigana

(10) Patent No.: US 6,675,520 B2
(45) Date of Patent: Jan. 13, 2004

(54) SAFETY DEVICE FOR PORTABLE FIREARMS

(75) Inventor: Lucio Burigana, Roveredo in Piano (IT)

(73) Assignee: Benelli Armi S.p.A., Urbino (IT)

( * ) Notice: Subject to any disclaimer, the term of this patent is extended or adjusted under 35 U.S.C. 154(b) by 0 days.

(21) Appl. No.: 10/192,187

(22) Filed: Jul. 9, 2002

(65) Prior Publication Data

US 2003/0014897 A1 Jan. 23, 2003

(30) Foreign Application Priority Data

Jul. 17, 2001 (IT) ..... MI2001A1514

(51) Int. Cl.[7] ..... F41A 17/44; F41A 17/02; F41A 17/42

(52) U.S. Cl. ..... 42/70.11

(58) Field of Search ..... 42/70.01, 70.11

(56) References Cited

U.S. PATENT DOCUMENTS

| | | | | | |
|---|---|---|---|---|---|
| 2,530,560 | A | * | 11/1950 | Young | 42/70.01 |
| 3,018,576 | A | * | 1/1962 | Riechers | 42/70.11 |
| 3,089,272 | A | | 5/1963 | McKinlay | |
| 3,378,943 | A | | 4/1968 | Valburg | |
| 3,634,963 | A | * | 1/1972 | Hermann | 42/70.11 |
| 3,765,115 | A | * | 10/1973 | Johansson et al. | 42/70.11 |
| 4,266,356 | A | | 5/1981 | Järvinen | |
| 4,827,649 | A | * | 5/1989 | Sheehan | 42/70.11 |
| 5,044,105 | A | * | 9/1991 | Lindley et al. | 42/70.11 |
| 5,115,589 | A | * | 5/1992 | Shuker | 42/70.11 |
| 5,331,759 | A | * | 7/1994 | Marceau et al. | 42/70.11 |
| 5,669,252 | A | | 9/1997 | Bentley | |
| 5,680,724 | A | | 10/1997 | Peterken | |

FOREIGN PATENT DOCUMENTS

| | | | | |
|---|---|---|---|---|
| DE | 29 08 066 A | | 9/1979 | |
| WO | WO 8809475 A1 | * | 12/1988 | F41C/17/08 |
| WO | WO 9853268 A | | 11/1998 | |

* cited by examiner

*Primary Examiner*—Charles T. Jordan
*Assistant Examiner*—John W. Zerr
(74) *Attorney, Agent, or Firm*—R. Neil Sudol; Henry D. Coleman; William J. Sapone

(57) ABSTRACT

A safety device for portable firearms, provided in the form of a padlock that includes a main body provided with a lock and with an active portion that is adapted to be locked in a position of interference between the barrel extension, or breech, and the head of the breechblock of the weapon, in order to prevent the operation thereof.

6 Claims, 5 Drawing Sheets

SAFETY DEVICE FOR PORTABLE FIREARMS

BACKGROUND OF THE INVENTION

1. Field of the Invention

The present invention relates to a safety device for portable firearms.

2. Description of the Prior Art

Safety systems for preventing unauthorized use of portable firearms, such as rifles and guns, have long been known.

This safety requirement, which is particularly felt in the home if children are present, has also been prescribed by recent statutory provisions.

Conventional systems are mostly in the form of key-operated or combination padlocks that can be applied to the firing mechanism of the firearm, usually to the trigger.

For example, padlocks are known which are constituted by a sort of jaw that grips the trigger region in order to prevent access thereto.

Other conventional devices are constituted by interference members that prevent the trigger from moving and therefore prevent the weapon from firing.

The conventional safety devices have different characteristics and also different drawbacks.

Some are very bulky or extremely troublesome to apply and deactivate.

Other conventional devices are scarcely reliable and others prevent firing but do not prevent loading the weapon.

WO-98/53268, U.S. Pat. Nos. 5,669,252, 3,089,272, 5,680,724 and DE-2908066, disclose gun locks to be applied at or in the firing chamber of a gun to prevent unauthorized use thereof.

The aim of the present invention is to provide a safety device for portable firearms that is improved with respect to the systems of the prior art.

OBJECTS OF THE INVENTION

An object of the invention is to provide a safety device in the form of a padlock that is compact and absolutely safe.

A further object of the invention is to provide a safety device that in addition to preventing use of the firearm also prevents loading it.

A further object is to provide a safety device that is dedicated to the weapon to which it is to be applied, so that its operation is optimized for that particular weapon.

SUMMARY OF THE INVENTION

This aim, these objects and others that will become better apparent hereinafter are achieved by a safety device for portable firearms, as claimed in the appended claims.

BRIEF DESCRIPTION OF THE DRAWINGS

Further characteristics and advantages of the present invention will become better apparent from the description of preferred but not exclusive embodiments thereof, illustrated only by way of non-limitative example in the accompanying drawings, wherein.

DESCRIPTION OF THE PREFERRED EMBODIMENTS OF THE INVENTION

Figure 1:
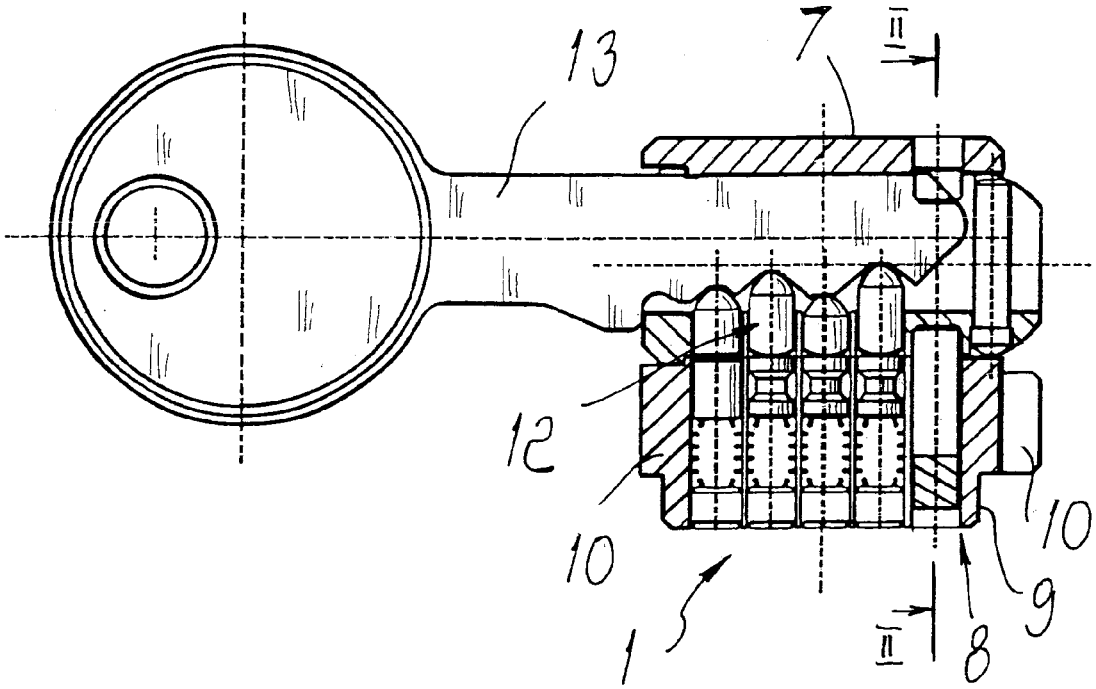
FIG. 1 is a sectional side view of the safety device and of its key according to the invention.
Figure 2:
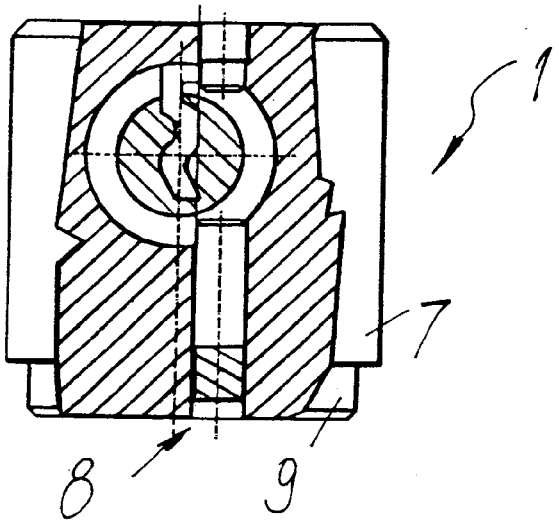
FIG. 2 is a sectional front view of the safety device, taken along the line II—II of FIG. 1.

With reference to FIGS. 1 to 7, the safety device, according to the invention, generally designated by the reference numeral 1, is provided in the form of a padlock and can be applied in particular to a weapon provided with closure recesses inside the barrel extension, or breech, such as for example a smoothbore firearm such as an automatic or semiautomatic rifle or a pump-action shotgun 2 which has, in a per se known manner, an ejection slot 3 at a breech 6 of a barrel 4.

According to the invention, the safety device, provided in the form of a padlock 1, includes a body 7 provided with a head 8 that emulates the shape of the head of the breechblock of the firearm and is adapted to close the breech 6, acting like the head of the breechblock.

In the illustrated case, the head 8 has a cylindrical portion 9 having two diametrically opposite radial protrusions 10 that are crescent-shaped and are adapted to engage corresponding slots formed on the inner surface of the breech 6, with a rotary motion about a longitudinal axis 11 of the body of the padlock 1.

Figure 6:
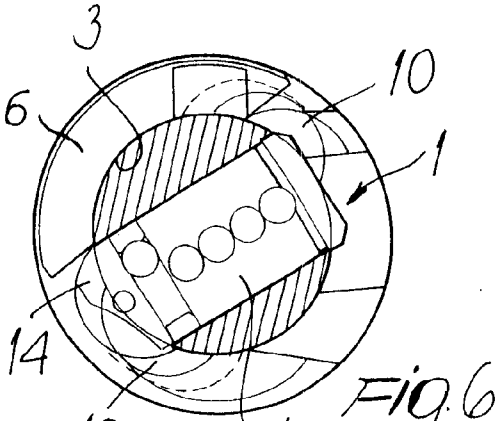
FIG. 6 is a transverse sectional view of the safety device, applied to the breechblock and shown in the closed position.
Figure 3:
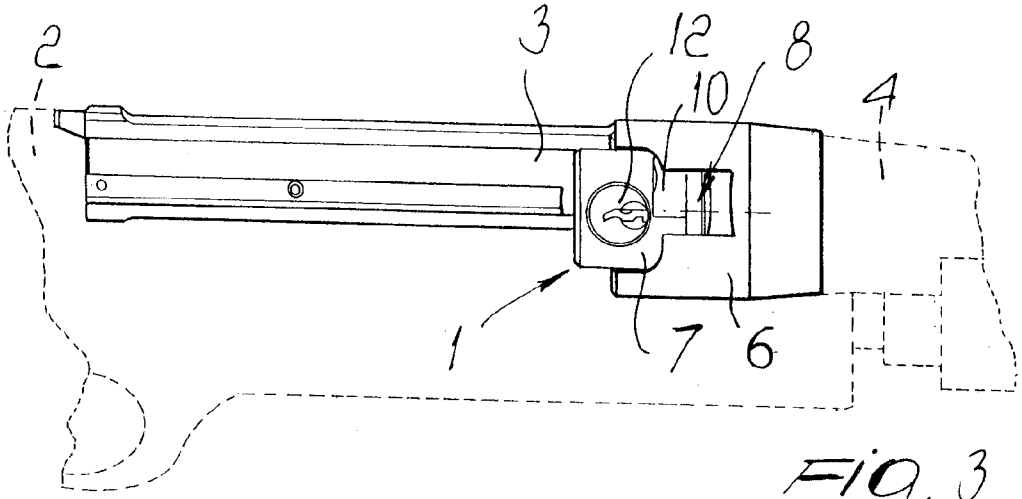
FIG. 3 is a partial side view of a firearm and of the safety device, shown in the open position.
Figure 5:
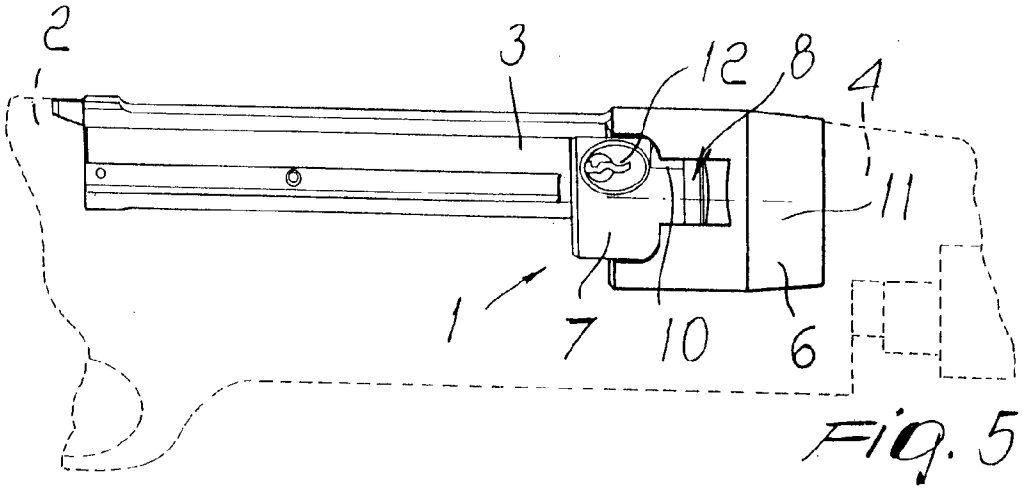
FIG. 5 is a partial side view of the firearm and of the safety device, shown in the closed position.
Figure 7:
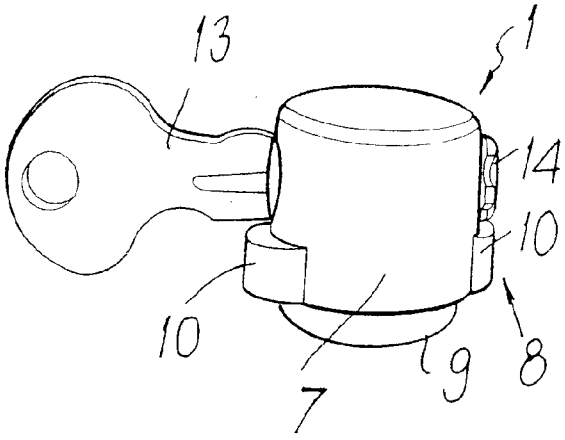
FIG. 7 is a schematic perspective view of the safety device of the preceding figures.

The padlock 1 also has a cylinder lock 12, of a per se known type, which can be operated by means of a key 13 and is associated with an interference member 14 so that, after turning the body 7 of the padlock 1 so that the radial protrusions 10 have engaged the slots of the breech, the body can be locked in this position by the interference member 14, which prevents any rotation, to the right with reference to FIG. 6, of the body 7 and therefore prevents the extraction of the padlock from the breech.

The operation of the padlock according to the invention is as follows.

Figure 4:
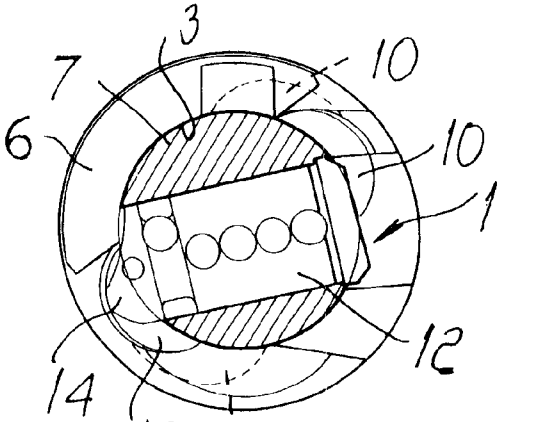
FIG. 4 is a transverse sectional view of the safety device, applied to the breechblock and shown in the open position.

In order to apply the padlock to the firearm it is sufficient to retract the breechblock and insert the head 8 of the padlock in the breech, passing through the ejection slot, so as to insert the radial protrusions in the slots of the breech, and turning the padlock body through a few degrees, as shown in FIGS. 4 and 6.

When the head of the padlock is inserted in the breech, it is sufficient to turn the key 13 to actuate the interference member 14 that prevents the body 7 of the padlock from turning and therefore prevents its disengagement from the breech.

When the padlock is closed in the breech, not only is the firearm unable to work, but it is also impossible to load a cartridge into the firing chamber.

To release the padlock it is sufficient to act in reverse with respect to the above description.

FIGS. 8 to 15 illustrate a safety device 101 according to a further aspect of the invention.

Also in this case, the safety device, provided in the form of a padlock 101, interferes with the closure of the breechblock, but in a rifled firearm provided with a small ejection slot, such as for example a carbine or a pistol, which has, in a per se known manner, an ejection slot 103 at the breech of the barrel 104.

The padlock 101 has a main body 107 provided with a lock 112 that can be operated by means of a key in order to turn a rotating block 108.

Figure 8:
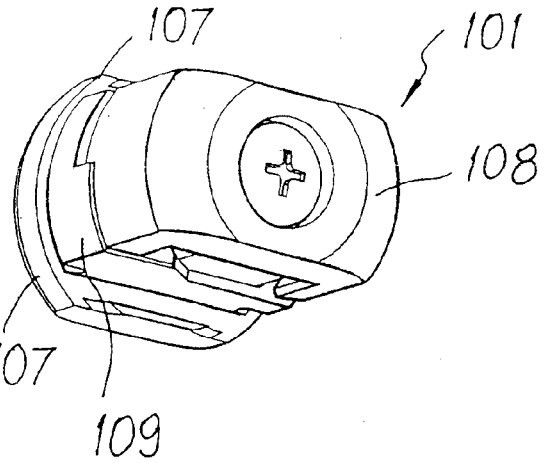
FIG. 8 is a rear perspective view of a safety device according to another aspect of the invention, shown in the position in which the lock is open.
Figure 9:
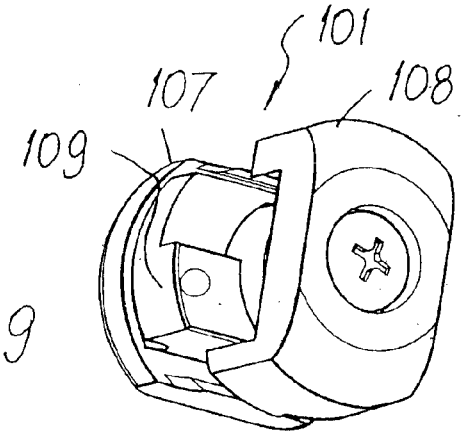
FIG. 9 is a view that is similar to FIG. 8 but shows the safety device in the position in which the lock is closed.
Figure 10:
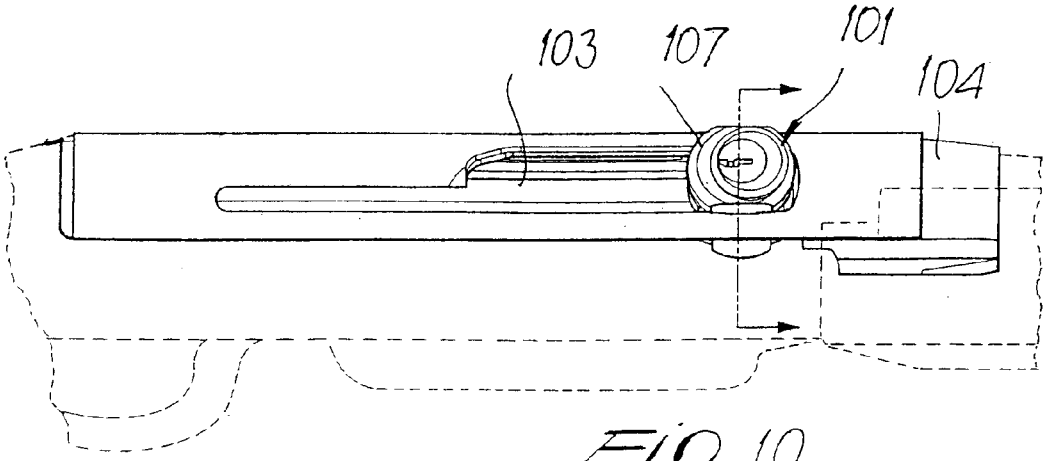
FIG. 10 is a partial side view of a firearm and of the safety device of FIGS. 8 and 9, shown in the open position.
Figure 11:
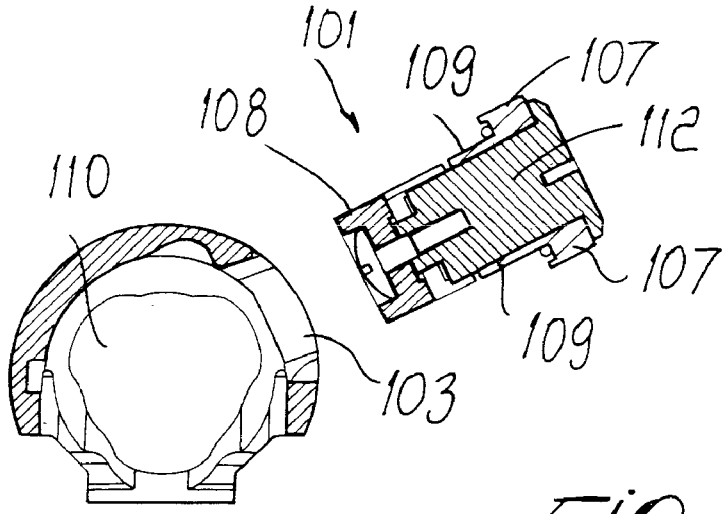
FIG. 11 is a front sectional view of the barrel extension (breech) of the firearm and of the safety device of FIGS. 8 to 10.
Figure 12:
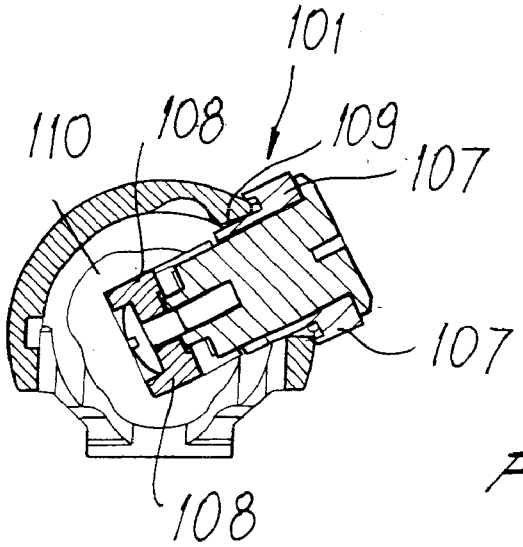
FIG. 12 is a view, similar to FIG. 11, of the safety device in the position for use but open.
Figure 13:
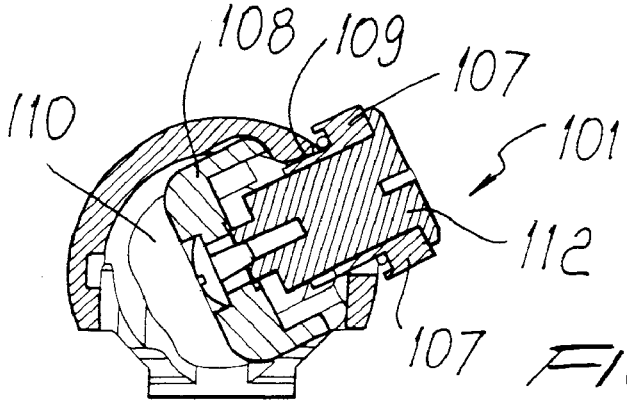
FIG. 13 is a view, similar to FIG. 12, but with the safety device in the closed position.
Figure 14:
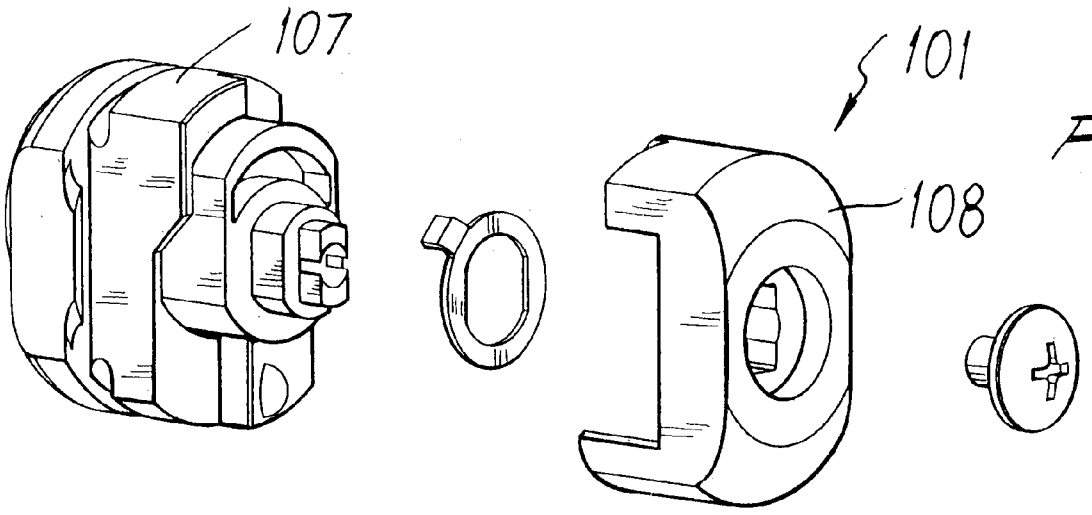
FIG. 14 is an exploded perspective view of the safety device of FIGS. 8 to 13.
Figure 15:
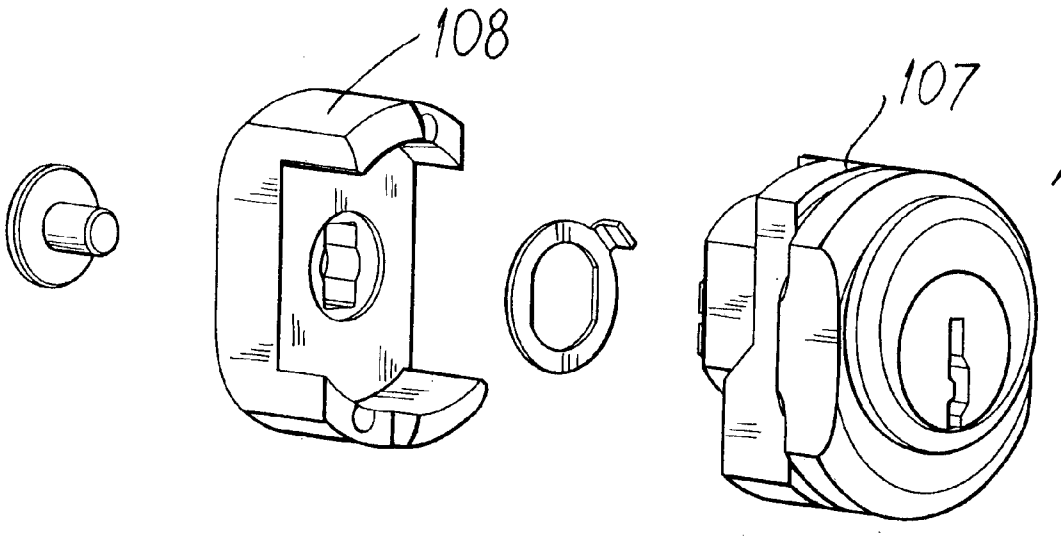
FIG. 15 is a view that is similar to FIG. 14 but taken from the opposite side.

The rotating block 108 has an elongated shape that corresponds to an elongated member 109 of the body 107, so that in the position in which the lock is open, shown in FIGS. 8, 11 and 12, the rotating block 108 and the elongated member 109 can enter the ejection slot 103, as shown in FIG. 12.

While the elongated member 109 remains at the ejection slot 103, since the body 107, which is larger than the ejection slot 103, abuts against the outer edges of the slot, the rotating block 108 fully enters the region 110 where the breechblock of the firearm slides.

By turning the lock, by means of the corresponding key, the rotating block 108 is turned through approximately 90°, interfering with the inner edges of the ejection slot 103 and at the same time obstructing the breech.

Also in this case the operation of the padlock according to the invention is easy and extremely safe.

Since the spaces in this type of weapon are considerably smaller than in smoothbore weapons, the rotating block 108, which constitutes the active portion of the padlock 101, is not inserted in the breech, as in the preceding case, but lies in front of it, in the space normally occupied by the closed breechblock.

Also in this case the padlock prevents all operation and loading of the weapon.

In practice it has been observed that the invention achieves the intended aim and objects, a safety device for portable firearms having been provided that is structurally simple and compact and highly reliable in use.

The safety device according to the invention is susceptible of numerous modifications and variations, within the scope of the appended claims. All the details may be replaced with technically equivalent elements.

The materials used, as well as the dimensions, may of course be any according to requirements and to the state of the art.

What is claimed is:

1. A safety device for a portable firearm having a barrel extension, a breech, and a breechblock provided with a head, said safety device comprising a main body provided with a lock and with an active portion that is adapted to be locked in a position of interference between said barrel extension, or breech, and said head of the breechblock, in order to prevent the operation thereof;

said active portion having a head comprising a cylindrical portion having two diametrically opposite radial protrusions that are crescent-shaped and are adapted to engage within corresponding slots formed in an internal surface of the breech, with a rotary motion about a longitudinal axis of the main body of the safety device;

said device further comprising a cylinder lock that can be actuated by a key and is associated with an interference member so that after the main body of the safety device has been turned so that the radial protrusions have engaged the slots of the breech, said main body can be locked in said position by the interference member, which prevents the extraction of the safety device from the breech.

2. A safety device for a portable firearm having a barrel extension, a breech, and a breechblock provided with a head, and an ejection slot having outer and inner edges, said safety device comprising a main body provided with a lock and with an active portion that is adapted to be locked in a position of interference between said barrel extension, or breech, and said head of the breechblock, in order to prevent the operation thereof; said lock being actuated by a key in order to turn a rotating block that constitutes said active portion; said rotating block having an elongated shape that corresponds to an elongated member of the main body, so that in a position in which the lock is open said rotating block and said elongated member can enter said ejection slot, while the elongated member remains at the ejection slot and the main body, which is larger than the ejection slot, abuts against outer edges of said slot, said rotating block instead entering fully a region where the breechblock of the firearm slides.

3. The safety device according to claim 2, wherein upon a turning of the lock by said key, said rotating block is turned through approximately 90°, interfering with inner edges of the ejection slot and at the same time obstructing the breech.

4. A safety device for a portable firearm having a barrel extension, a breech, and a breechblock provided with a breechblock head, said safety device comprising:

a main body and an active portion coupled to said main body and adapted to be locked in a position of interference between (a) one of said barrel extension and said breech and (b) said breechblock head, in order to prevent the operation of said breechblock, said active portion including a respective head emulating said breechblock head, said respective head including a cylindrical portion having two diametrically opposite radial protrusions that are crescent-shaped and are adapted to engage within corresponding slots formed in an internal surface of the breech, upon a rotary motion about a longitudinal axis of said main body;

a key-actuated cylinder lock provided on said main body and coupled with an interference member for locking the main body in position to prevent the extraction of the safety device from the breech, after the body of the safety device has been turned so that the radial protrusions have engaged the slots of the breech.

5. A safety device for a portable firearm having a barrel extension, a breech, a breechblock provided with a head, and an ejection slot having outer and inner edges, said safety device comprising:

a main body, a lock, and an active portion adapted to be locked in a position of interference between (a) one of said barrel extension and said breech and (b) said head of the breechblock, in order to prevent the operation thereof;

said active portion including a block rotatable relative to said main body, said lock being actuatable by a key in order to turn the rotatable block of said active portion, said main body member having an elongated member, said rotatable block having an elongated shape that is substantially coextensive in at least one dimension with said elongated member, so that in a position in which the lock is open said rotatable block and said elongated member can enter said ejection slot, while the main body remains at the ejection slot abutting against outer edges of said ejection slot and while said rotatable block instead enters fully a region where the breechblock slides.

6. The safety device according to claim 5, wherein said rotatable block is rotatable through an angle of approximately 90°, upon a turning of the lock by said key, to interfere with inner edges of said ejection slot and at the same time to obstruct the breech.

* * * * *